US010038266B2

(12) United States Patent
Nakashima et al.

(10) Patent No.: US 10,038,266 B2
(45) Date of Patent: Jul. 31, 2018

(54) FEMALE TERMINAL FITTING AND CONNECTOR PROVIDED WITH THE SAME

(71) Applicants: YAZAKI CORPORATION, Tokyo (JP); TOYOTA JIDOSHA KABUSHIKI KAISHA, Toyota-shi, Aichi-ken (JP)

(72) Inventors: Takahito Nakashima, Okazaki (JP); Hiroyasu Taga, Toyota (JP); Shogo Suzuki, Makinohara (JP); Yoshifumi Shinmi, Makinohara (JP)

(73) Assignees: YAZAKI CORPORATION, Tokyo (JP); TOYOTA JIDOSHA KABUSHIKI KAISHA, Aichi-ken (JP)

( * ) Notice: Subject to any disclaimer, the term of this patent is extended or adjusted under 35 U.S.C. 154(b) by 0 days.

(21) Appl. No.: 15/170,259

(22) Filed: Jun. 1, 2016

(65) Prior Publication Data

US 2016/0359253 A1 Dec. 8, 2016

(30) Foreign Application Priority Data

Jun. 2, 2015 (JP) ..... 2015-112608

(51) Int. Cl.

| | |
|---|---|
| ***H01R 13/40*** | (2006.01) |
| ***H01R 13/11*** | (2006.01) |
| ***H01R 13/193*** | (2006.01) |
| *H01R 4/18* | (2006.01) |
| *H01R 13/422* | (2006.01) |
| *H01R 13/52* | (2006.01) |

(52) U.S. Cl.

CPC ..... *H01R 13/113* (2013.01); *H01R 13/193* (2013.01); *H01R 4/18* (2013.01); *H01R 13/422* (2013.01); *H01R 13/5205* (2013.01)

(58) Field of Classification Search

CPC ..... H01R 13/4223; H01R 13/113
USPC ..... 439/595, 752.5, 852
See application file for complete search history.

(56) References Cited

U.S. PATENT DOCUMENTS

| | | | | |
|---|---|---|---|---|
| 4,919,628 | A * | 4/1990 | Mobley | H01R 13/113 439/852 |
| 5,630,738 | A * | 5/1997 | Ito | H01R 13/113 439/851 |
| 6,068,526 | A * | 5/2000 | Nottrott | H01R 13/11 439/845 |
| 6,146,215 | A * | 11/2000 | Matsushita | H01R 13/113 439/752 |

(Continued)

FOREIGN PATENT DOCUMENTS

| | | |
|---|---|---|
| JP | 2008-117554 A | 5/2008 |
| JP | 2012-48903 A | 3/2012 |

*Primary Examiner* — Thanh Tam Le
(74) *Attorney, Agent, or Firm* — Sughrue Mion, PLLC

(57) ABSTRACT

A female terminal fitting includes an electric connection portion having a bottom plate, side plates, and a top plate. An elastic contact piece opposed to the top plate or the bottom plate is provided inside the electric connection portion. The elastic contact piece includes a central contact which protrudes toward the top plate or the bottom plate. The top plate or the bottom plate includes a pair of contacts and a curved contact portion. The pair of contacts is provided respectively in widthwise edge portions of an inner surface of the top plate or the bottom plate. The curved contact portion is provided between the pair of contacts so as to be recessed like an arc.

10 Claims, 8 Drawing Sheets

(56) References Cited

U.S. PATENT DOCUMENTS

| | | | | |
|---|---|---|---|---|
| 6,547,608 | B2 * | 4/2003 | Sato | H01R 13/11 439/851 |
| 6,981,900 | B2 * | 1/2006 | Sakurai | H01R 13/64 439/595 |
| 7,128,606 | B2 * | 10/2006 | Sakamaki | H01R 13/4223 439/595 |
| 7,347,747 | B2 * | 3/2008 | Shimizu | H01R 13/11 439/842 |
| 7,544,106 | B2 * | 6/2009 | Muneyasu | H01R 13/113 439/852 |
| 7,785,159 | B2 * | 8/2010 | Kumakura | H01R 4/185 439/845 |
| 8,152,576 | B2 * | 4/2012 | Nakamura | H01R 13/055 439/852 |
| 8,622,769 | B2 * | 1/2014 | Mizutani | H01R 13/113 439/595 |
| 8,747,156 | B2 * | 6/2014 | Hirabayashi | H01R 13/113 439/595 |
| 8,784,144 | B2 * | 7/2014 | Hirabayashi | H01R 13/113 439/852 |
| 8,944,961 | B2 * | 2/2015 | Ainsworth | G06Q 10/06315 482/1 |
| 9,124,017 | B2 * | 9/2015 | Shinkawa | H01R 13/4223 |
| 2008/0102717 | A1 | 5/2008 | Muneyasu | |
| 2013/0165000 | A1 | 6/2013 | Shinkawa et al. | |

* cited by examiner

FEMALE TERMINAL FITTING AND CONNECTOR PROVIDED WITH THE SAME

CROSS REFERENCE TO RELATED APPLICATIONS

This application is based on Japanese Patent Application (No. 2015-112608) filed on Jun. 2, 2015, the contents of which are incorporated herein by reference.

BACKGROUND OF THE INVENTION

1. Field of the Invention

The present disclosure relates to a female terminal fitting to be conductively connected to a male terminal fitting, and a connector provided with the female terminal fitting.

2. Description of the Related Art

For example, a female terminal fitting has a box-like body portion to which a tab of a male terminal fitting on the connection counterpart side can be inserted, and has an elastic contact piece which is provided with a contact portion protruding into the body portion so that the contact portion can contact with the tab (for example, see JP-A-2008-117554 and JP-A-2012-48903). In this female terminal fitting, a pair of left and right reception portions protruding toward the inside of the body portion are formed on the opposite side to the contact portion. By this configuration, the female terminal fitting contacts with the tab of the male terminal fitting at three points, that is, the contact portion and the pair of reception portions on the opposite side to the contact portion, so that a conductive connection state can be obtained.

When the female terminal fitting and the male terminal fitting are connected to each other in a state where they are inclined axially relatively to each other, one of the pair of reception portions may be separated from the tab. In this case, the female terminal fitting is in contact with the tab at two points, that is, the contact portion and the other of the pair of reception portions. Thus, the conductive connection state becomes unstable as compared with that in the contact at the three points. On the other hand, with a request to miniaturize a connector, a female terminal fitting to be received in a housing of the connector has been requested to be further miniaturized.

SUMMARY OF THE INVENTION

The present disclosure has been developed in consideration of the aforementioned situation. An object of the present disclosure is to provide a female terminal fitting capable of securing a stable conductive connection state with a male terminal fitting while attaining miniaturization, and a connector provided with the female terminal fitting.

The aforementioned object of the present disclosure is attained by the following configurations.

(1) A female terminal fitting including:

an electric connection portion formed into a rectangular cylindrical shape and that includes a bottom plate, side plates provided on opposite side portions of the bottom plate, and a top plate provided in a position opposed to the bottom plate, wherein an elastic contact piece opposed to the top plate or the bottom plate is provided inside the electric connection portion;

wherein when a rod-like tab of a male terminal fitting formed into a rectangular shape in sectional view is inserted into the electric connection portion, the tab is sandwiched by the top plate or the bottom plate and the elastic contact piece so that the female terminal fitting is conductively connected to the male terminal fitting;

wherein the elastic contact piece includes a central contact that is provided in a widthwise central portion so as to protrude like an arc toward the top plate or the bottom plate; and wherein the top plate or the bottom plate includes a pair of contacts and a curved contact portion, the pair of contacts is provided respectively in widthwise edge portions of an inner surface of the top plate or the bottom plate so as to protrude toward the elastic contact piece, and the curved contact portion is provided between the pair of contacts so as to be recessed like an arc.

(2) A female terminal fitting including:

an electric connection portion formed into a rectangular cylindrical shape and that includes a bottom plate, side plates provided on opposite side portions of the bottom plate, and a top plate provided in a position opposed to the bottom plate, wherein an elastic contact piece opposed to the top plate or the bottom plate is provided inside the electric connection portion;

wherein when a rod-like tab of a male terminal fitting formed into a rectangular shape in sectional view is inserted into the electric connection portion, the tab is sandwiched by the top plate or the bottom plate and the elastic contact piece so that the female terminal fitting is conductively connected to the male terminal fitting;

wherein the top plate or the bottom plate includes a central contact that is provided in a widthwise central portion of an inner surface of the top plate or the bottom plate so as to protrude like an arc toward the elastic contact piece; and wherein the elastic contact piece includes a pair of contacts and a curved contact portion, the pair of contacts is provided respectively in widthwise edge portions of an inner surface of the elastic contact piece so as to protrude toward the top plate or the bottom plate, and the curved contact portion is provided between the pair of contacts so as to be recessed like an arc.

(3) A connector including:

a housing including a plurality of terminal reception portions; and female terminal fittings according to the configuration (1) or (2), which are received in the terminal reception portions of the housing respectively.

According to the present disclosure, it is possible to provide a female terminal fitting capable of securing a stable conductive connection state with a male terminal fitting while attaining miniaturization, and a connector provided with the female terminal fitting.

The present disclosure has been described briefly. Further, the details of the present disclosure will be made clearer through the following "DETAILED DESCRIPTION OF THE EXEMPLARY EMBODIMENTS" (hereinafter referred to as "embodiment") with reference to the accompanying drawings.

DETAILED DESCRIPTION OF THE EXEMPLARY EMBODIMENTS

An embodiment according to the present disclosure will be described below with reference to the drawings.

Figure 1:
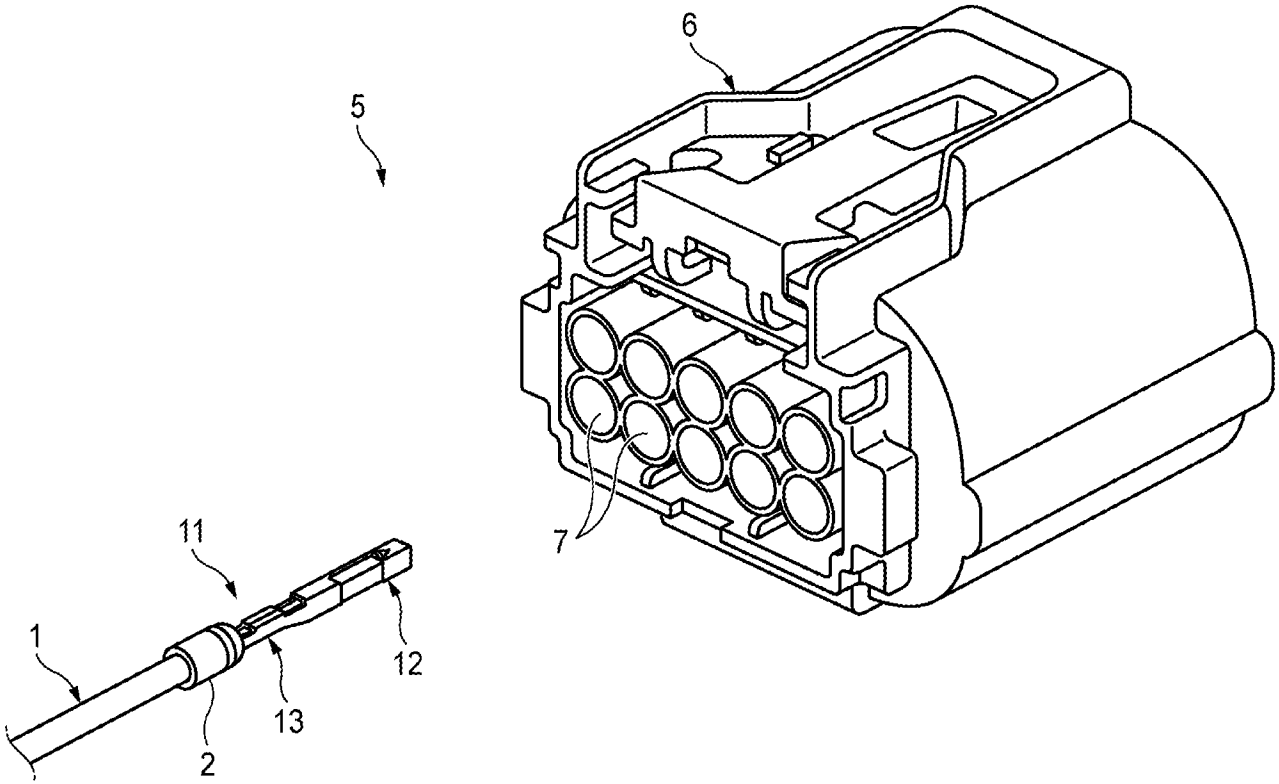
FIG. 1 is a perspective view of a female terminal fitting and a housing constituting a connector according to an embodiment of the present disclosure.

FIG. 1 is a perspective view of a female terminal fitting and a housing according to the embodiment of the present disclosure.

As illustrated in FIG. 1, a connector 5 according to the embodiment includes a housing 6 and a female terminal fitting 11. The female terminal fitting is provided in an end portion of an insulated wire 1 in which a conductor is covered with a sheath. The female terminal fitting 11 is received in the housing 6 to form the connector 5. The housing 6 is formed out of resin to include a plurality of terminal reception portions 7. In the housing 6, the female terminal fitting 11 is inserted into one of the terminal reception portions 7 from the rear of the housing 6. Thus, the female terminal fitting 11 is received and retained in the terminal reception portion 7 of the housing 6. A rubber stopper 2 is attached to an end portion of the insulated wire 1. The rubber stopper 2 is fitted to the terminal reception portion 7. Thus, the terminal reception portion 7 in which the female terminal fitting 11 is received is sealed by the rubber stopper 2.

Figure 2:
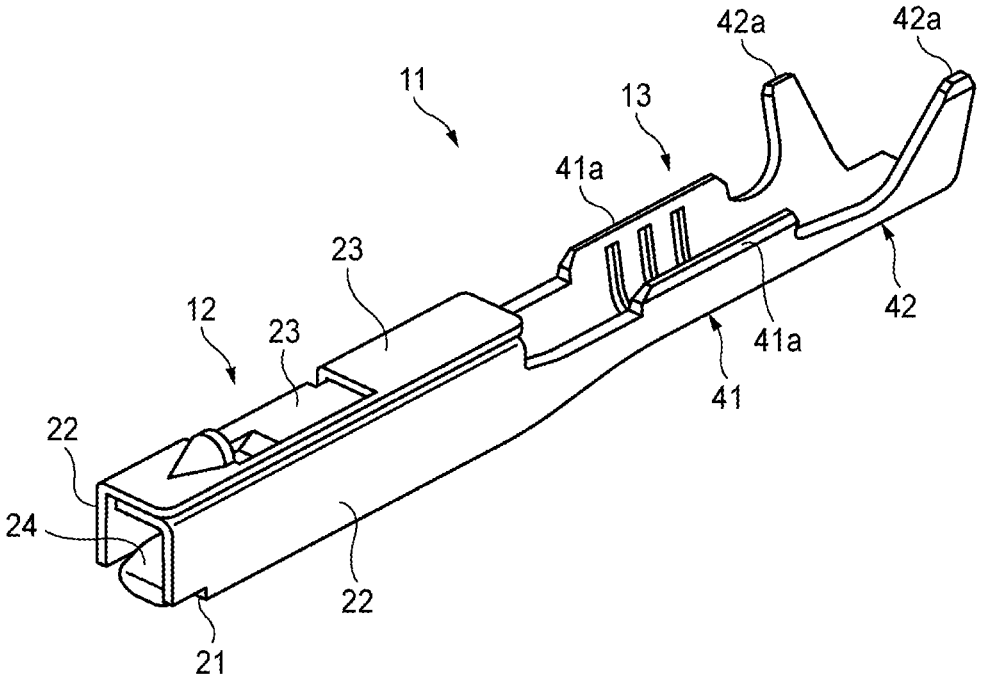
FIG. 2 is a perspective view of the female terminal fitting according to the embodiment of the present disclosure.
Figure 3:
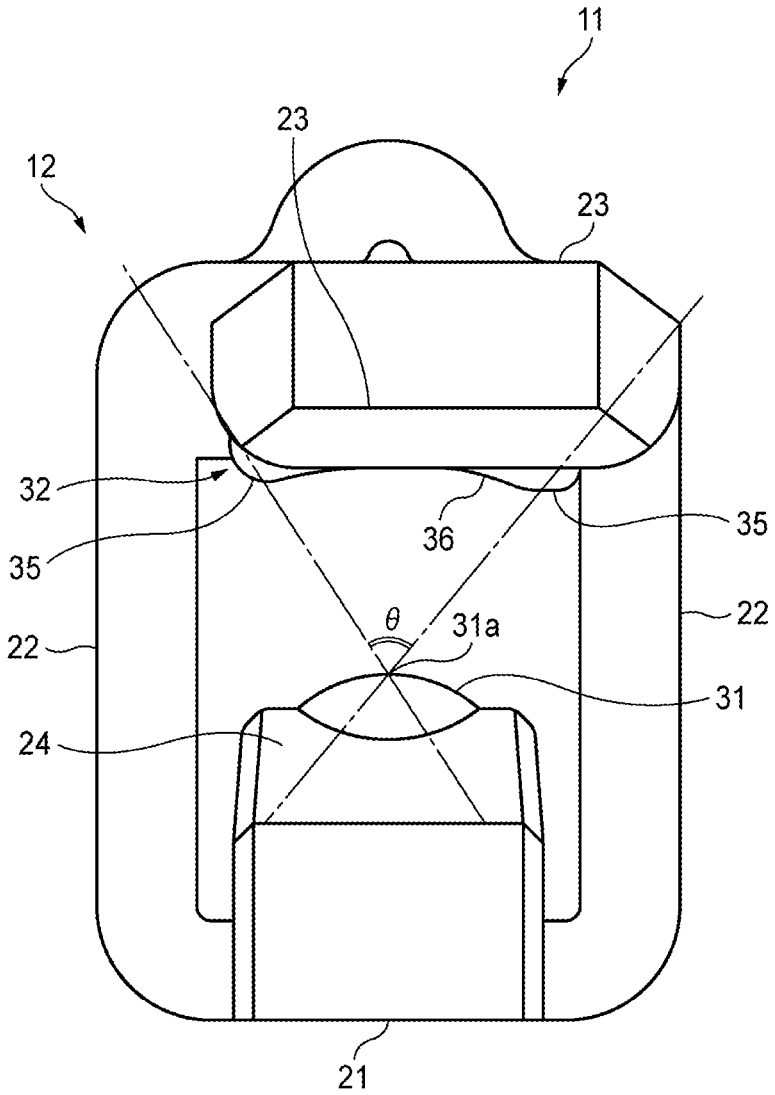
FIG. 3 is a front view of an electric connection portion of the female terminal fitting according to the embodiment of the present disclosure.

FIG. 2 is a perspective view of the female terminal fitting according to the embodiment of the present disclosure. FIG. 3 is a front view of an electric connection portion of the female terminal fitting according to the embodiment of the present disclosure.

As illustrated in FIG. 2, the female terminal fitting 11 includes an electric connection portion 12 and a wire connection portion 13. The female terminal fitting 11 is, for example, formed out of a conductive metal material such as copper or a copper alloy. To form the female terminal fitting 11, the conductive metal material is punched out and bent by press forming.

The electric connection portion 12 is formed into a rectangular cylindrical shape. A tab 54 of a male terminal fitting 51 that will be described later is inserted into the electric connection portion 12 from the front end side opposite to the wire connection portion 13.

As illustrated in FIG. 3, the electric connection portion 12 includes a bottom plate 21, side plates 22 rising from opposite side portions of the bottom plate 21, and a top plate 23 extending from an upper edge of one of the side plates 22 toward an upper end of the other side plate 22. An elastic contact piece 24 is formed in the bottom plate 21. The elastic contact piece 24 is folded inward on the front end side in the bottom plate 21, and elongated toward the rear end. The elastic contact piece 24 is formed to bulge slightly toward the top plate 23. Thus, a slight clearance is formed between the bottom plate 21 and the elastic contact piece 24. A central contact 31 protruding toward the top plate 23 is formed at the widthwise center of the elastic contact piece 24. The central contact 31 is formed into an arc in which a widthwise center portion serves as a vertex 31*a*.

A contact conduction portion 32 is provided on the top plate 23. The contact conduction portion 32 has a pair of contacts 35 protruding toward the central contact 31. The contacts 35 are formed on widthwise edge portions of an inner surface of the top plate 23. The contacts 35 are, for example, ribs extending in a perpendicular direction to the paper surface of FIG. 3. In addition, a curved contact portion 36 is provided between the contacts 35. The curved contact portion 36 is formed into a concave shape recessed like an arc. The curved contact portion 36 is formed into an arc connecting the vertex of one of the contacts 35 with the vertex of the other of the contacts 35. The contact conduction portion 32 including the pair of contacts 35 and the curved contact portion 36 can be formed easily by embossing with a press superior in workability.

The wire connection portion 13 of the female terminal fitting 11 includes a conductor crimping portion 41 and a sheath crimping portion 42 which are located in this order from a side of the electric connection portion 12. The conductor crimping portion 41 has a pair of conductor caulking pieces 41*a*, and the sheath crimping portion 42 has a pair of sheath caulking pieces 42*a*. A conductor exposed in an end portion of the insulated wire 1 is caulked by the conductor caulking pieces 41*a* to be thereby crimped to the conductor crimping portion 41. Thus, the female terminal fitting 11 is conductively connected to the conductor of the insulated wire 1. On the other hand, an end portion of a sheath part of the insulated wire 1 is caulked by the sheath caulking pieces 42*a* to be thereby crimped and fixed to the sheath crimping portion 42.

Figure 4:
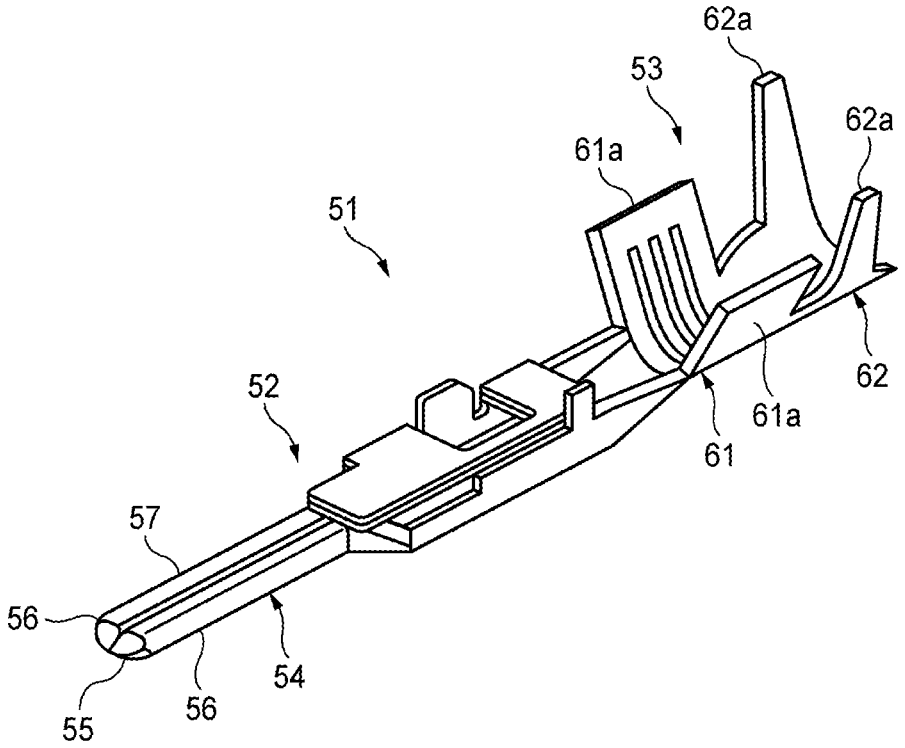
FIG. 4 is a perspective view of a male terminal fitting to be connected to the female terminal fitting.
Figure 5:
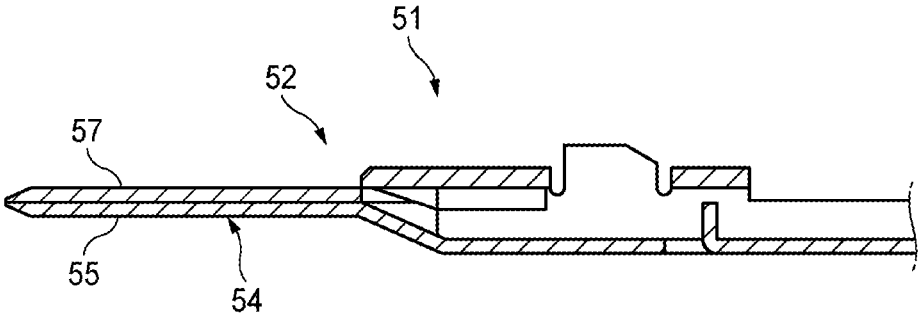
FIG. 5 is a sectional view taken along the longitudinal direction of the male terminal fitting to be connected to the female terminal fitting.

FIG. 4 is a perspective view of a male terminal fitting to be connected to the female terminal fitting. FIG. 5 is a sectional view taken along the longitudinal direction of the male terminal fitting to be connected to the female terminal fitting.

As illustrated in FIG. 4 and FIG. 5, the male terminal fitting 51 to be connected to the female terminal fitting 11 includes an electric connection portion 52 and a wire connection portion 53. The male terminal fitting 51 is, for example, formed out of a conductive metal material such as copper or a copper alloy. The conductive metal material is punched out and bent by press forming to form the male terminal fitting 51. The electric connection portion 52 has a rod-like tab 54 protruding to the front. The tab 54 has a rectangular sectional shape including a lower surface 55, side surfaces 56 and an upper surface 57.

The electric connection portion 53 of the male terminal fitting 51 includes a conductor crimping portion 61 and a sheath crimping portion 62 in order from the electric connection portion 52 side. The conductor crimping portion 61 has a pair of conductor caulking pieces 61*a*, and the sheath crimping portion 62 has a pair of sheath caulking pieces 62*a*. A conductor exposed in an end portion of the insulated wire 1 is caulked by the conductor caulking pieces 61*a* to be thereby crimped to the conductor crimping portion 61. Thus, the male terminal fitting 51 is conductively connected to the conductor of the insulated wire 1. On the other hand, an end portion of a sheath part of the insulated wire 1 is caulked by the sheath caulking pieces 62*a* to be thereby crimped and fixed to the sheath crimping portion 62.

The male terminal fitting 51 is received in a terminal reception portion of a housing (not shown) of a counterpart-side connector to be joined to the connector 5.

Next, description will be made about a case in which the female terminal fitting 11 and the male terminal fitting 51 are connected.

Figure 6:
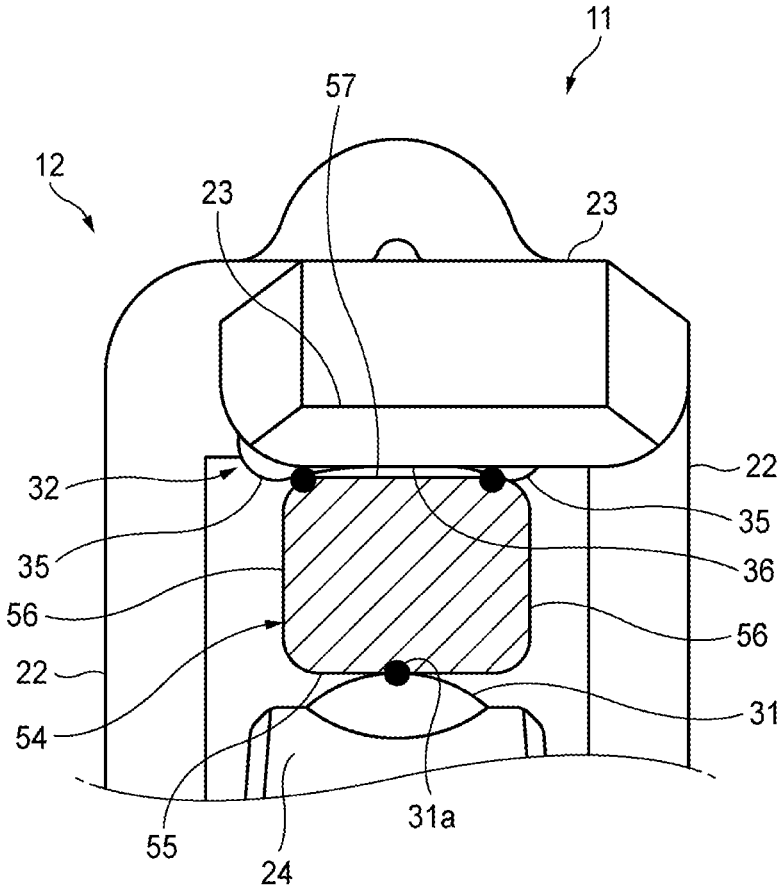
FIG. 6 is a front view of the electric connection portion showing a connection state between the female terminal fitting according to the embodiment and the male terminal fitting including a tab observed in sectional view.
Figure 7:
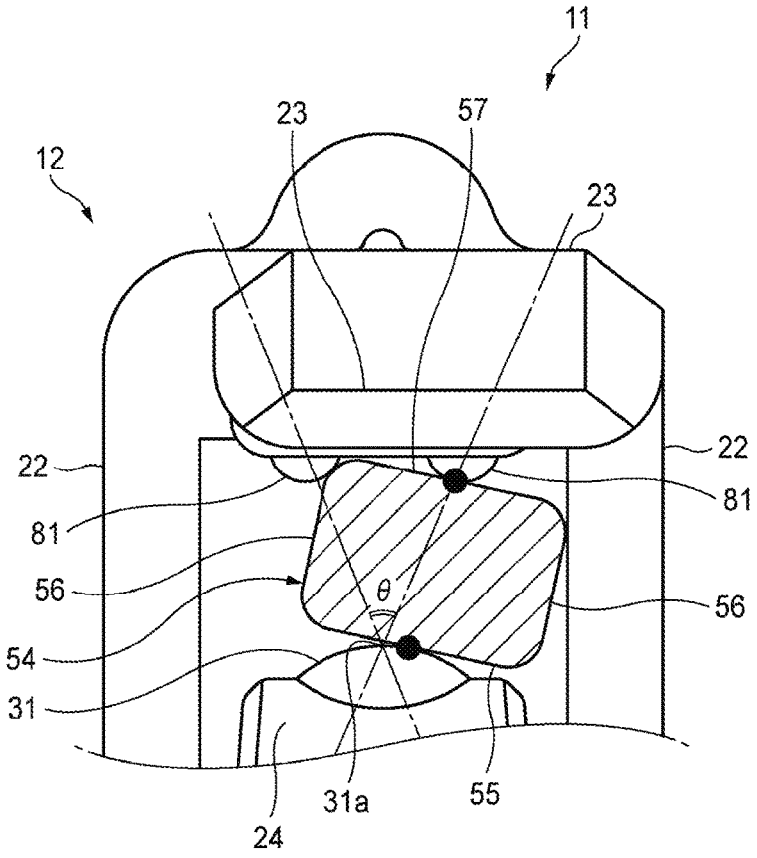
FIG. 7 is a front view of an electric connection portion showing a connection state between a female terminal fitting according to a reference example and the male terminal fitting including the tab observed in sectional view.
Figure 8:
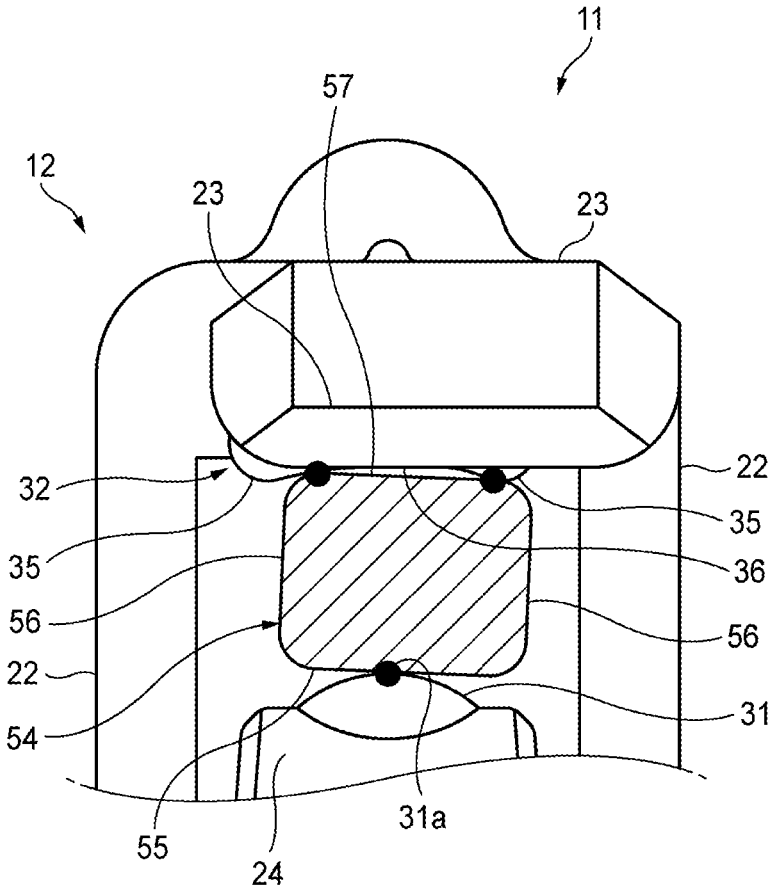
FIG. 8 is a front view of the electric connection portion showing a connection state between the female terminal fitting according to the embodiment and the male terminal fitting including the tab observed in sectional view.

FIG. 6 is a front view of the electric connection portion showing a connection state between the female terminal fitting according to the embodiment and the male terminal fitting including the tab observed in sectional view. FIG. 7 is a front view of an electric connection portion showing a connection state between a female terminal fitting according to a reference example and the male terminal fitting including the tab observed in sectional view. FIG. 8 is a front view of the electric connection portion showing a connection state between the female terminal fitting according to the embodiment and the male terminal fitting including the tab observed in sectional view.

When the housing of the counterpart-side connector provided with the male terminal fitting 51 is joined to the housing 6 of the connector 5 provided with the female terminal fitting 11, the female terminal fitting 11 of the connector 5 and the male terminal fitting 51 of the counterpart-side connector are conductively connected.

Specifically, as illustrated in FIG. 6, when the housing of the counterpart-side connector is joined to the housing 6 of the connector 5, the tab 54 of the male terminal fitting 51 is inserted into the electric connection portion 12 of the female terminal fitting 11. The elastic contact piece 24 is pressed and bent toward the bottom plate 21 by the tab 54. Thus, the tab 54 of the male terminal fitting 51 is sandwiched between the top plate 23 and the elastic contact piece 24 by the elastic force of the elastic contact piece 24. As a result, the central contact 31 of the elastic contact piece 24 contacts with the lower surface 55 of the tab 54 of the male terminal fitting 51, and each of the pair of contacts 35 of the contact conduction portion 32 of the top plate 23 contacts with the upper surface 57 of the tab 54 of the male terminal fitting 51.

In this manner, when the tab 54 of the male terminal fitting 51 is inserted into the electric connection portion 12 of the female terminal fitting 11, the electric connection portion 12 contacts with the tab 54 at three points, that is, the central contact 31 and the two contacts 35 in sectional view. Thus, a stable conductive connection state is secured.

The female terminal fitting 11 may be received in the terminal reception portion 7 of the housing 6 in the state where the female terminal fitting 11 is inclined about its axis. In the same manner, the male terminal fitting 51 may be received in the terminal reception portion 7 of the housing 6 in the state where the male terminal fitting 51 is inclined about its axis.

When the female terminal fitting 11 and the male terminal fitting 51 are inclined axially relatively to each other, the following problem arises in a configuration in which a pair of contacts 81 are simply provided to protrude at a widthwise interval on the top plate 23 as illustrated in FIG. 7. That is, one of the contacts 81 is separated from the upper surface 57 of the tab 54 so that contact with the tab 54 can be secured at only two points, that is, the central contact 31 and one of the contacts 81 in sectional view. Accordingly, in this case, the conductive connection state becomes unstable, as compared with the contact at the three points.

On the other hand, in the female terminal fitting 11 according to the embodiment, the curved contact portion 36 recessed like an arc is provided between the pair of contacts 35 formed on the widthwise edge portions of the inner surface of the top plate 23. Accordingly, as illustrated in FIG. 8, even when one of the pair of contacts 35 in the contact conduction portion 32 is separated from the tab 54 because the female terminal fitting 11 and the male terminal fitting 51 are inclined axially relatively to each other, a corner portion of the tab 54 can contact with the curved contact portion 36. As a result, the electric connection portion 12 contacts with the tab 54 at three points, that is, the central contact 31, the other of the pair of contacts 35, and the curved contact portion 36 in sectional view. Thus, a stable conductive connection state can be secured.

In this manner, according to the female terminal fitting 11 according to the embodiment, when the tab 54 is inserted into the electric connection portion 12, contact with the tab 54 can be secured at three points, that is, the central contact 31 and the pair of contacts 35. Thus, a stable conductive connection state can be secured. In addition, the curved contact portion 36 recessed like an arc is provided between the pair of contacts 35 in the top plate 23. Accordingly, even when one of the pair of contacts 35 is separated from the tab 54 because the electric connection portion 12 and the tab 54 are inclined axially relatively to each other, a corner portion of the tab 54 can contact with the curved contact portion 36. As a result, contact can be secured at three points, that is, the central contact 31, the other of the pair of contacts 35, and the curved contact portion 36 in sectional view. Thus, a stable conductive connection state can be secured.

In addition, in the structure in which the paired contacts 81 are simply provided to protrude at a widthwise interval on the top plate 23, an angle θ between straight lines connecting the central contact 31 and each contact 81 becomes small (see FIG. 7). Thus, the balance in contact with the tab 54 among the central contact 31 and the contacts 81 becomes unstable.

On the other hand, in the female terminal fitting 11 according to the embodiment, the contacts 35 are formed on the widthwise edge portions of the inner surface of the top plate 23. Accordingly, while the electric connection portion 12 is miniaturized, the distance between the contacts 35 can be secured to the maximum to increase the angle θ between the straight lines connecting the central contact 31 and each of the contacts 35 (see FIG. 3). The central contact 31 and the contacts 35 can be brought into contact with the tab 54 in good balance. Thus, a stable conductive connection state can be maintained.

According to the connector 5 provided with the female terminal fitting 11 configured thus, the housing 6 can be miniaturized. In addition, the connector 5 can be made reliable enough to secure a stable conductive connection state with the male terminal fitting 51 when the connector 5 is joined to a counterpart-side connector.

Incidentally, in the aforementioned embodiment, the central contact 31 is formed on the elastic contact piece 24, and the contact conduction portion 32 including the pair of contacts 35 and the curved contact portion 36 is formed on the top plate 23. However, the central contact 31 may be formed on the top plate 23, and the contact conduction portion 32 including the pair of contacts 35 and the curved contact portion 36 may be formed on the elastic contact piece 24.

In addition, in the aforementioned embodiment, the elastic contact piece 24 opposed to the top plate 23 is formed on the bottom plate 21. However, the elastic contact piece 24 opposed to the bottom plate 21 may be formed on the top plate 23. Also in this case, the central contact 31 may be formed on the elastic contact piece 24, and the contact conduction portion 32 including the pair of contacts 35 and the curved contact portion 36 may be formed on the bottom plate 21. Alternatively, the central contact 31 may be formed on the bottom plate 21, and the contact conduction portion 32 including the pair of contacts 35 and the curved contact portion 36 may be formed on the elastic contact piece 24.

Incidentally, the present disclosure is not limited to the aforementioned embodiment, but suitable deformations, improvements and so on may be made thereon. In addition, materials, shapes, dimensions, numbers, arrangement places, etc. of constituent elements in the aforementioned embodiments are not limited but may be selected desirably if the present disclosure can be attained.

Here, the aforementioned features of the embodiment of the female terminal fitting and the connector provided with the same according to the present disclosure will be summarized and listed in the following paragraphs [1] to [3] respectively.

[1] A female terminal fitting (11) including:

an electric connection portion (12) formed into a rectangular cylindrical shape and that includes a bottom plate (21), side plates (22) provided on opposite side portions of the bottom plate (21), and a top plate (23) provided in a position opposed to the bottom plate (21), wherein an elastic contact piece (24) opposed to the top plate (23) or the bottom plate (21) is provided inside the electric connection portion (12);

wherein when a rod-like tab (54) of a male terminal fitting (51) formed into a rectangular shape in sectional view is inserted into the electric connection portion (12), the tab (54) is sandwiched by the top plate (23) or the bottom plate (21) and the elastic contact piece (24) so that the female terminal fitting (11) is conductively connected to the male terminal fitting (51);

wherein the elastic contact piece (24) includes a central contact (31) that is provided in a widthwise central portion so as to protrude like an arc toward the top plate (23) or the bottom plate (21); and wherein the top plate (23) or the bottom plate (21) includes a pair of contacts (35) and a curved contact portion (36), the pair of contacts (35) is provided respectively in widthwise edge portions of an inner surface of the top plate (23) or the bottom plate (21) so as to protrude toward the elastic contact piece (24), and the curved contact portion (36) is provided between the pair of contacts (35) so as to be recessed like an arc.

[2] A female terminal fitting including:

an electric connection portion formed into a rectangular cylindrical shape and that includes a bottom plate, side plates provided on opposite side portions of the bottom plate, and a top plate provided in a position opposed to the bottom plate, wherein an elastic contact piece opposed to the top plate or the bottom plate is provided inside the electric connection portion;

wherein when a rod-like tab of a male terminal fitting formed into a rectangular shape in sectional view is inserted into the electric connection portion, the tab is sandwiched by the top plate or the bottom plate and the elastic contact piece so that the female terminal fitting is conductively connected to the male terminal fitting;

wherein the top plate or the bottom plate includes a central contact that is provided in a widthwise central portion of an inner surface of the top plate or the bottom plate so as to protrude like an arc toward the elastic contact piece; and wherein the elastic contact piece includes a pair of contacts and a curved contact portion, the pair of contacts is provided respectively in widthwise edge portions of an inner surface of the elastic contact piece so as to protrude toward the top plate or the bottom plate, and the curved contact portion is provided between the pair of contacts so as to be recessed like an arc.

[3] A connector including:

a housing (6) including a plurality of terminal reception portions (7); and female terminal fittings according to the paragraph [1] or [2], which are received in the terminal reception portions (7) of the housing (6) respectively.

According to the terminal fitting having the aforementioned configuration [1], the tab is inserted into the electric connection portion so that contact with the tab can be secured at three points, that is, the central contact and the paired contacts. Thus, a stable conductive connection state can be secured. In addition, the curved contact portion sinking like an arc is provided between the contacts in the top plate or the bottom plate. Accordingly, even when the tab is separated from one of the contacts because the electric connection portion and the tab are inclined axially relatively to each other, a corner portion of the tab can contact with the curved contact portion. In sectional view, contact with the tab can be secured at three points, that is, the central contact, one of the contacts, and the curved contact portion. Thus, a stable conductive connection state can be secured.

In addition, the contacts are formed on the widthwise edge portions of the inner surface of the top plate or the bottom plate. Accordingly, while the electric connection portion is miniaturized, the distance between the contacts can be secured to the maximum to increase the angle between the straight lines connecting the central contact and each of the contacts. The central contact and the contacts can be brought into contact with the tab in good balance. Thus, a stable conductive connection state can be maintained.

According to the terminal fitting having the aforementioned configuration [2], the tab is inserted into the electric connection portion so that contact with the tab can be secured at three points, that is, the central contact and the paired contacts. Thus, a stable conductive connection state can be secured. In addition, the curved contact portion sinking like an arc is provided between the contacts in the elastic contact piece. Accordingly, even when the tab is separated from one of the contacts because the electric connection portion and the tab are inclined axially relatively to each other, a corner portion of the tab can contact with the curved contact portion. In sectional view, contact with the tab can be secured at three points, that is, the central contact, one of the contacts, and the curved contact portion. Thus, a stable conductive connection state can be secured.

In addition, the contacts are formed on the widthwise edge portions of the inner surface of the elastic contact piece. Accordingly, while the electric connection portion is miniaturized, the distance between the contacts can be secured to the maximum to increase the angle between the straight lines connecting the central contact and each of the contacts. The central contact and the contacts can be brought into contact with the tab in good balance. Thus, a stable conductive connection state can be maintained.

According to the connector having the aforementioned configuration [3], the housing can be miniaturized. In addition, the connector can be made reliable enough to secure a stable conduction state with a male terminal fitting when the connector is joined to a counterpart-side connector.

What is claimed is:

1. A female terminal fitting comprising:

an electric connection portion formed into a rectangular cylindrical shape and that includes a bottom plate, side plates provided on opposite side portions of the bottom plate, and a top plate provided in a position opposed to the bottom plate, wherein an elastic contact piece opposed to the top plate or the bottom plate is provided inside the electric connection portion;

wherein when a rod-like tab of a male terminal fitting formed into a rectangular shape in sectional view is inserted into the electric connection portion, the tab is sandwiched by the top plate or the bottom plate and the elastic contact piece so that the female terminal fitting is conductively connected to the male terminal fitting;

wherein the elastic contact piece includes a central contact that is provided in a widthwise central portion so as to protrude like an arc toward the top plate or the bottom plate;

wherein the top plate or the bottom plate includes a pair of contacts provided respectively on outermost widthwise edge portions of an inner surface of the top plate or the bottom plate so as to protrude toward the elastic contact piece, and a curved contact portion provided between a distal end of each contact of the pair of contacts so as to be recessed like an arc; and wherein each contact of the pair of contacts has a convex portion that extends from an outermost widthwise edge portion of the outermost widthwise edge portions of the inner surface of the top plate or the bottom plate so that an angle, formed by first and second straight virtual lines that each intersects a peak of a convex portion of a contact of the pair of contacts and a peak of the central contact of the elastic contact piece, is maximized so as to ensure a more stable connection between the rod-like tab of the male terminal fitting and the electric connection portion.

2. The female terminal fitting of claim 1 further comprising a wire connection portion including a conductor crimping portion and a sheath crimping portion.

3. The female terminal fitting of claim 2 wherein the male terminal fitting is inserted in the electric connection portion from the front end side opposite to the wire connection portion.

4. The female terminal fitting of claim 1, wherein the curved contact portion connects a vertex of one of the pair of contacts with a vertex of the other of the pair of the contacts.

5. A female terminal fitting comprising:

an electric connection portion formed into a rectangular cylindrical shape and that includes a bottom plate, side plates provided on opposite side portions of the bottom plate, and a top plate provided in a position opposed to the bottom plate, wherein an elastic contact piece opposed to the top plate or the bottom plate is provided inside the electric connection portion;

wherein when a rod-like tab of a male terminal fitting formed into a rectangular shape in sectional view is inserted into the electric connection portion, the tab is sandwiched by the top plate or the bottom plate and the elastic contact piece so that the female terminal fitting is conductively connected to the male terminal fitting;

wherein the top plate or the bottom plate includes a central contact that is provided in a widthwise central portion of an inner surface of the top plate or the bottom plate so as to protrude like an arc toward the elastic contact piece;

wherein the elastic contact piece includes a pair of contacts provided respectively on outermost widthwise edge portions of an inner surface of the elastic contact piece so as to protrude toward the top plate or the bottom plate, and a curved contact portion provided between a distal end of each contact of the pair of contacts so as to be recessed like an arc; and wherein each contact of the pair of contacts has a convex portion that extends from an outermost widthwise edge portion of the outermost widthwise edge portions of the inner surface of the elastic contact piece so that an angle, formed by first and second straight virtual lines that each intersects a peak of a convex portion of a contact of the pair of contacts and a peak of the central contact of the top plate or the bottom plate, is maximized so as to ensure a more stable connection between the rod-like tab of the male terminal fitting and the electric connection portion.

6. The female terminal fitting of claim 5 further comprising a wire connection portion including a conductor crimping portion and a sheath crimping portion.

7. The female terminal fitting of claim 6 wherein the male terminal fitting is inserted in the electric connection portion from the front end side opposite to the wire connection portion.

8. The female terminal fitting of claim 5, wherein the curved contact portion connects a vertex of one of the pair of contacts with a vertex of the other of the pair of the contacts.

9. A connector comprising:

a housing including a plurality of terminal reception portions; and female terminal fittings according to claim 1, which are received in the terminal reception portions of the housing respectively.

10. A connector comprising:

a housing including a plurality of terminal reception portions; and female terminal fittings according to claim 5, which are received in the terminal reception portions of the housing respectively.

* * * * *